US011208796B2

(12) United States Patent
Gilde et al.

(10) Patent No.: US 11,208,796 B2
(45) Date of Patent: Dec. 28, 2021

(54) CYLINDER-PISTON UNIT

(71) Applicant: LIXIL INTERNATIONAL Pte. Ltd., Singapore (SG)

(72) Inventors: Christian Gilde, Karlsruhe (DE); Achim Heinzle, Ras Al Khaimah (AE); Oliver Seidel, Karlsruhe (DE)

(73) Assignee: LIXIL INTERNATIONAL Pte. Ltd., Singapore (SG)

( * ) Notice: Subject to any disclaimer, the term of this patent is extended or adjusted under 35 U.S.C. 154(b) by 0 days.

(21) Appl. No.: 16/958,672

(22) PCT Filed: Dec. 28, 2018

(86) PCT No.: PCT/IB2018/060689
§ 371 (c)(1),
(2) Date: Jun. 26, 2020

(87) PCT Pub. No.: WO2019/130261
PCT Pub. Date: Jul. 4, 2019

(65) Prior Publication Data

US 2021/0062489 A1 Mar. 4, 2021

(30) Foreign Application Priority Data

Dec. 28, 2017 (DE) ..... 10 2017 131 400.8

(51) Int. Cl.
*E03D 5/02* (2006.01)

(52) U.S. Cl.
CPC ..... *E03D 5/024* (2013.01)

(58) Field of Classification Search
CPC ..... E03D 5/024; E03D 5/02
USPC ..... 4/415
See application file for complete search history.

(56) References Cited

U.S. PATENT DOCUMENTS

| | | | | |
|---|---|---|---|---|
| 2,738,946 | A | 3/1956 | Filliung | |
| 4,230,145 | A * | 10/1980 | Badders | E03D 1/30 137/410 |
| 5,456,279 | A | 10/1995 | Parsons et al. | |
| 5,513,394 | A | 5/1996 | Kodaira | |
| 6,616,119 | B2 | 9/2003 | Wilson | |
| 2002/0117641 | A1 | 8/2002 | Nortier | |
| 2016/0208471 | A1 * | 7/2016 | Yu | E03D 5/01 |
| 2018/0223513 | A1 * | 8/2018 | Gu | E03D 9/16 |

FOREIGN PATENT DOCUMENTS

| | | | |
|---|---|---|---|
| CN | 101655115 | B | 3/2013 |
| CN | 205877202 | U | 1/2017 |
| DE | 102014019290 | A1 | 3/2016 |
| EP | 0094229 | B1 | 4/1989 |
| EP | 1749941 | A1 | 2/2007 |

(Continued)

*Primary Examiner* — Huyen D Le
(74) *Attorney, Agent, or Firm* — Tyler A. Stevenson; Anna-lisa L. Gallo

(57) ABSTRACT

A cylinder-piston unit for actuating a flush valve, comprising a piston which is displaceably mounted in a cylinder and the piston rod of which is operatively connected to a flush valve, and comprising at least one fluid inlet, which opens into the cylinder at or below a lower stop position of the piston, and comprising at least one fluid outlet wherein the piston comprises at least one valve which seals the piston in a lower stop position and opens at least one passage opening in an upper stop position.

14 Claims, 7 Drawing Sheets

(56) References Cited

FOREIGN PATENT DOCUMENTS

| | | | |
|---|---|---|---|
| EP | 3048207 | A1 | 7/2016 |
| GB | 447056 | A | 5/1936 |
| WO | 96/14479 | A1 | 5/1996 |
| WO | 98/48121 | A1 | 10/1998 |
| WO | 2014/184776 | A1 | 11/2014 |

* cited by examiner

CYLINDER-PISTON UNIT

CROSS-REFERENCE TO RELATED APPLICATIONS

This application is a national stage application under 35 USC 371 of International Application No. PCT/IB2018/060689, filed Dec. 28, 2018, which claims the priority of German Application No. 10 2017 131 400.8, filed Dec. 28, 2017, the entire contents of each of which are incorporated herein by reference.

FIELD OF THE DISCLOSURE

The present disclosure relates to a cylinder-piston unit for actuating a flush valve, comprising a piston which is displaceably mounted in a cylinder and the piston rod of which is operatively connected to a flush valve, and comprising at least one fluid inlet, which opens into the cylinder at or below a lower stop position of the piston, and comprising at least one fluid outlet.

BACKGROUND OF THE DISCLOSURE

Such cylinder-piston units are already known from the related art. For example, DE 10 2014 019 290 A1 describes a flushing device, in which a triggering of the flushing process in a cistern is to take place by means of the inflow of tap water. In this case, the tap water is introduced into the cylinder due to the line pressure and, in the cylinder, flows under the piston. Due to the water pressure, the piston is lifted against the force of a compression spring. Since the piston rod is connected to the flush valve, the flush valve is lifted off of the valve seat along with the lifting of the piston, and the flushing process can take place. As the water pressure in the cylinder decreases, the piston lowers again until it reaches a lower stop position, in which the flush valve is likewise closed.

Solutions which are similar, in principle, are also described in EP 0 094 229 B1 and in EP 1 749 941 A1, in which the counteracting force, against which the piston is lifted, is likewise applied by a compression spring.

Such a solution results in the problem, however, that the spring constant of the compression spring must be selected in such a way that the compression spring must be loaded by the water pressure at the beginning of the flushing process but, in turn, must be strong enough at the end of the flushing process to allow the piston to return to the starting position. The piston should more or less remain in the deflected position thereof during the flushing process.

This can certainly be accomplished, but a person skilled in the art will determine that he/she must take the applied water pressure into account in this case. The water pressure in the supply network can differ regionally by varying degrees, however, and can even deviate by a great extent in different countries. Although the solutions including compression springs also cover a certain pressure range, they do not cover the pressure range required by the standard. As a result, the solutions have different characteristics in different regions and do not function everywhere, resulting in the effect that a check must be initially carried out to determine which compression spring is to be utilized in order to ensure optimal operation. In general, however, floats are utilized, which has the disadvantage that floats require a substantial amount of space in the cistern and the determination of the flushing quantity becomes highly complex.

A slightly different approach is taken by the subject matter of EP 3 048 207 A1 which provides a hollow piston which can be lifted slightly when water flows into the cylinder. In order to terminate the flushing process, the hollow piston is then filled with water, and therefore the piston becomes heavier and descends back into its original position.

Such a solution requires a highly complex design, however, which includes a second water supply of the cylinder having a movable water supply of the piston.

SUMMARY OF THE DISCLOSURE

Against this background, the problem addressed by the present disclosure is that of providing a cylinder-piston unit which reliably allows for the actuation of a flush valve in a structurally simple and cost-effective way and, simultaneously, in a substantially greater pressure range.

This is achieved by way of a cylinder-piston unit according to the features disclosed and/or claimed herein.

Furthermore, this is achieved by a method for actuating a flush valve with a cylinder-piston unit with the steps of the methods disclosed and/or claimed herein.

Further embodiments of such a cylinder-piston unit can be found in the disclosure and/or claims herein.

The cylinder-piston unit for actuating a flush valve comprises a piston which is displaceably mounted in a cylinder. The piston rod of the piston, which is in some embodiments formed integrally with the piston, is operatively connected to a flush valve (the flush valve to be actuated). The cylinder-piston unit further comprises at least one fluid inlet, which opens into the cylinder at or below a lower stop position of the piston and comprises at least one fluid outlet. The at least one fluid outlet (through which fluid can leave the cylinder) is in some embodiments arranged in the region of an upper stop position of the piston. The piston comprises at least one valve which seals the piston in a lower stop position (of the piston) and opens at least one passage opening (in or through the piston) in an upper stop position (of the piston). In other words, this could be described such that at least one valve of the piston is configured to (continuously) seal the piston in a lower stop position or the piston (by closing the at least one passage opening) and to (continuously) open at least one passage opening (in or through the piston) in an upper stop position of the piston.

According to the disclosure, it is initially provided, similarly to the aforementioned solutions, that the flushing process is triggered via a piston which is connected to the flush valve. The piston comprises a piston rod which is operatively connected to the flush valve and releases the water flow from the cistern when the piston is lifted. The piston is longitudinally displaceably situated in a cylinder which limits the displacement by way of a cylinder base and a cylinder cover. The piston rests circumferentially sealingly against the cylinder wall. A fluid inlet opens into the cylinder, through which the tap water can be introduced into the cylinder, wherein the fluid inlet is positioned in such a way that the inflowing water flows under the piston located in the lower stop position thereof. The piston is subsequently lifted by means of the pressure under the piston, whereby the piston rod integrally formed on the piston opens the upright tube and, therefore, triggers the flushing process.

Even before the upper stop position in the region of the cylinder cover has been reached, however, a valve is triggered, which opens at least one passage opening in the piston, and therefore the water, which has been located under the piston until now, can now also pass through the piston (more precisely through the valve(s) and/or passage opening(s) in the piston) into the region above the piston, and the water pressure under the piston decreases. The water passing through the piston can emerge from the cylinder via an upper outlet which is an overflow of the cylinder. As a result, the pressure under the piston is reduced to such an extent that the piston can remain in the upper end position thereof, due to the water still flowing in, but, as the water flow tapers off for closing the flush valve, the piston begins to descend. When the piston engages into the lower stop position thereof, the valve of the piston and the passage openings thereof close.

Such a solution functions largely independently of the applied water pressure, since all that is required is the weight of the piston to displace the piston back into the starting position thereof. Due to the displacement-controlled triggering of the valve, the properties of the piston change, depending on the position thereof, to such a great extent that no more additional forces are required.

In some embodiments, the piston comprises multiple valves (meaning that there are at least two valves of the at least one valve), each of which seals the piston in the lower stop position (of the piston) and opens at least one passage opening in the upper stop position (of the piston), the valves being, in some embodiments, situated on the piston so as to be distributed uniformly and further in some embodiments with circular symmetry. This can contribute to achieve a greater permeability of the piston in the open position of the valve. In the case of a uniform, in particular, circular distribution of the valves on the piston, a uniform pressure distribution on the piston is also ensured, thereby eliminating the possibility of tilting.

In some embodiments, the valve is formed from one or multiple valve tappets which continually engage through the passage opening and are longitudinally movably accommodated therein. Advantageously, these valve tappets comprise stops on both sides, and therefore the valve tappets are captively fastened on the piston and can assume a defined position in every phase of the flushing process.

In this case, the single valve tappet provides that the valve tappet is triggered by the valve tappet being pushed through the passage opening. The valve tappet can therefore comprise, for example, a wide lower closure section, with the aid of which the valve tappet seals the passage opening, and a tapering positioned opposite thereto, which, in the open state, enables fluid to flow past. The tapering can be provided in such a way that the round base region of the valve tappet blocking the passage opening tapers upward toward a central web.

In order to ensure that the valve tappet remains captive, a stop in the form of a bulge can be assigned to the valve tappet. In this case, it is useful to provide the central web with a vertical notch, in order to be able to thread the valve tappet, including the stop, into the passage opening.

In order to achieve a greater permeability of the piston in the open position of the valve, the piston can comprise multiple passage openings, each of which includes a valve tappet, wherein these valve tappets can be particularly advantageously connected to each other via a connecting ring. This connecting ring functions as a lower stop of the valve tappet, on the one hand and, on the other hand, the connecting ring evens out and synchronizes the movements of the valve tappet during opening and closing. In the case of a uniform, in particular, circular distribution of the valves on the piston, a uniform pressure distribution on the piston is also ensured, thereby eliminating the possibility of tilting.

In light of different options with respect to material selection, in the case of a plastic material that is too lightweight, in order to ensure that the valve tappet is not pushed back into the closed position by the existing water pressure as the piston lowers again, an additional lowering weight can be assigned to the valve tappets or, in some embodiments, the connecting ring, if present, or a lowering weight can be coextruded or integrally formed thereon, being made of a material having a greater density, and therefore the weight of the lowering weight holds the valve tappet open as the piston descends.

According to a second embodiment, the passage openings include a snap-fit closure which switches into an open position when the piston is in an upper stop position and snaps back into a closed position when a lower stop position of the piston is reached. In this case, it must be ensured, in some embodiments, that the weight of the descending piston or a force to be applied in any other way is sufficient for ensuring that the snap-fit closure snaps back into the closed position.

The water flowing into the cylinder must, in some embodiments, emerge from the cylinder again, and therefore a fluid outlet was also mentioned at the outset. This fluid outlet can be designed, on the one hand, as a seepage outlet which is formed around the piston rod protruding from the cylinder; the water will essentially escape on the upper face of the cylinder, however, through an overflow which opens into the cistern. The seepage outlet must, in some embodiments, therefore necessarily be smaller than the inlet, in order to be able to build up a water pressure in the cylinder that can lift the piston and, therewith, the flush valve. A suitable solution can be achieved by way of the fact that the piston rod is provided with multiple notches around the circumference thereof, and therefore a labyrinth seal is formed between the piston rod and the passage through the cylinder base which can be designed in the shape of a sleeve. After the passage openings are opened, the pressure under the piston decreases by a great extent, however, since the inflow can now escape through the overflow.

An additional seal can also be implemented on the circumferential edge of the piston, which glides along the inner wall of the cylinder. This seal can consist of a sealing ring which has a U-shaped cross-section, wherein the opening of the U-shape faces downward. As a result, the seal distends when there is pressure under the seal and additionally blocks the path of the fluid past the outer edge of the piston. As soon as the pressure under the piston decreases, however, and the pressure above the piston increases, the seal flattens out again and also makes it possible, in the borderline case, for fluid to run downward on the outside, past the edge of the piston.

In order to ensure that there is a secure seat of the flush valve in the closed state, the lower stop position of the piston should be selected in such a way that, in this lower stop position, the piston rod is decoupled from the flush valve. This can be implemented, with respect to the connection between the flush valve and the piston rod, via a sliding bearing, for which a head of the piston rod forms a stop, and therefore the displacement of the piston can carry along the sliding bearing.

Since the piston must, in some embodiments, therefore reliably return to the lower stop position again along the final extent, without the weight and the restoring force of the flush valve associated therewith, an additional lowering weight can be also be assigned to the piston or the piston rod by way of a suitable selection of material.

According to a further aspect of the disclosure a method for actuating a flush valve with a cylinder-piston unit is disclosed, the cylinder-piston unit comprising a piston which is displaceably mounted in a cylinder and the piston rod of which is operatively connected to the flush valve, and comprising at least one fluid inlet, which opens into the cylinder at or below a lower stop position of the piston, and comprising at least one fluid outlet, the method comprising the steps of:

a) Lifting the piston from its lower stop position by introducing fluid through the at least one fluid inlet into the cylinder, wherein the piston comprises at least one valve which seals the piston in its lower stop position,
b) Triggering the at least one valve to open at least one passage opening in the piston when or before the piston reaches its upper stop position, so that the fluid, which has been located beneath the piston so far, can now also pass through the piston into the region above the piston, where the fluid passing through the piston can leave the cylinder via the at least one fluid outlet,
c) Triggering the at least one valve to close the at least one passage opening in the piston when the piston engages into its lower stop position.

Usually steps a), b) and c) are carried out in the given order. In some embodiments, the method is carried out for actuating a flush valve with a cylinder-piston unit as disclosed herein. Furthermore, the cylinder-piston unit as disclosed herein, can be configured for carrying out the method disclosed herein.

According to some embodiments of the method, the triggering of the at least one valve occurs displacement-controlled. This means in particular that the condition or valve position of the at least one valve changes depending on the displacement or position of the piston, e.g. depending on whether the piston is in its upper stop position or in its lower stop position. Thereby, the condition of the at least one valve can automatically change (only) in dependence of the displacement or position of the piston. In this regard, the conditions of the at least one valve comprise at least one or more opened conditions and one closed condition.

According to a further aspect, the use (method of use) of a cylinder-piston unit as disclosed herein for actuating a flush valve is disclosed. Thereby, the cylinder-piston unit is in some embodiments used in(-side) a cistern and/or to release fluid from the cistern into a toilet.

According to a further aspect, a cistern for flushing a toilet can be disclosed, the cistern comprising a cylinder-piston unit as disclosed herein. Thereby, the cylinder-piston unit is in some embodiments placed in(-side) the cistern. Usually the flush valve connected to the cistern can open and close a flush outlet of the cistern. Furthermore, an arrangement or system comprising a cistern and a toilet can be disclosed. The cistern can comprise a cylinder-piston unit as disclosed herein, which is in some embodiments arranged in(-side) the cistern.

The details, features and advantageous embodiments described in connection with the cylinder-piston unit can accordingly also occur in the case of the method, and/or the used described above, and vice versa. In this regard, reference is made in full to the statements made there, for a more detailed characterization of the features.

BRIEF DESCRIPTION OF THE FIGURES

The above-described disclosure is described in greater detail in the following with reference to some embodiments.

DETAILED DESCRIPTION OF THE DISCLOSURE

Figure 1:
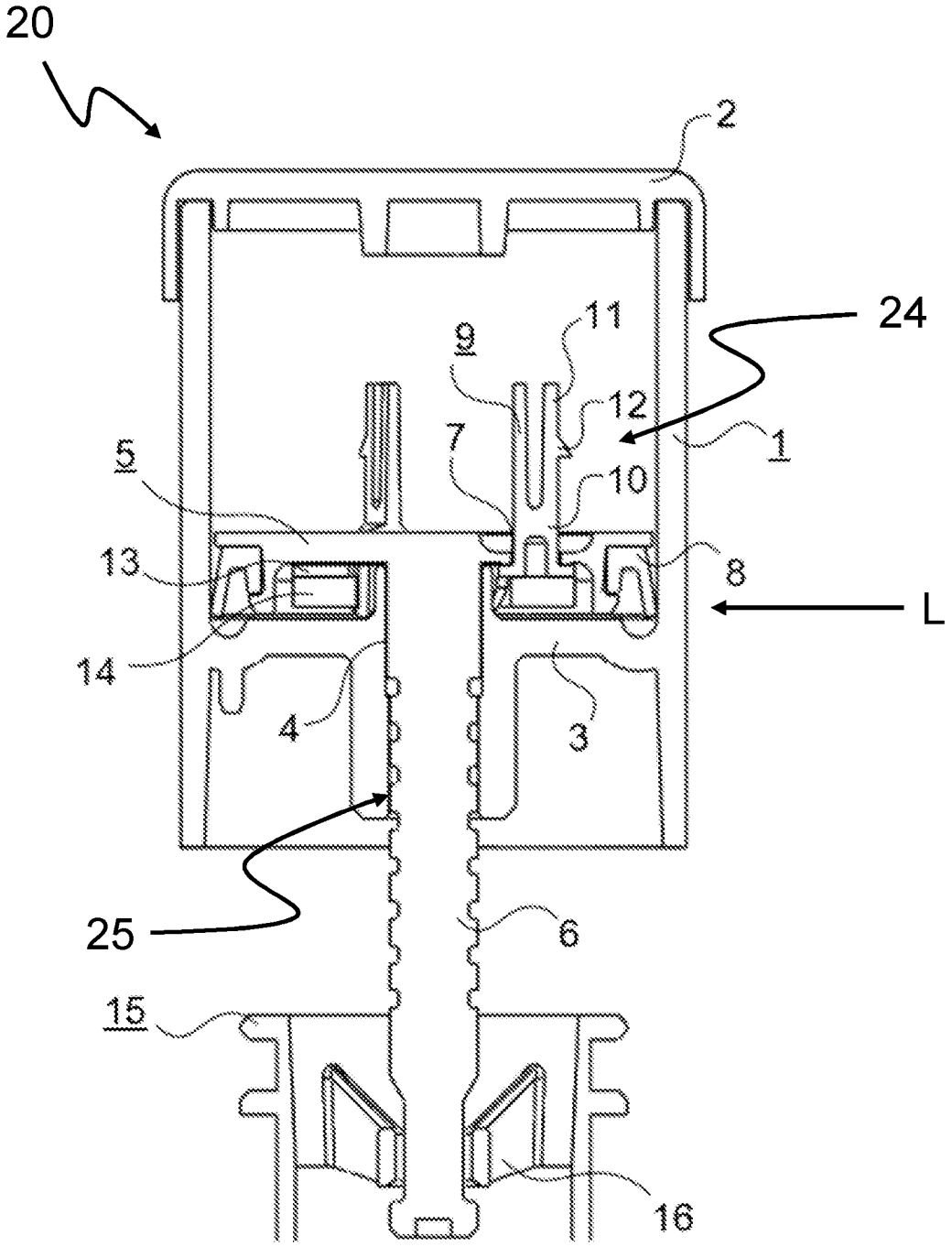
FIG. 1 shows a cross-sectional view from the side of a cylinder-piston unit comprising multiple valve tappets engaging through the piston, in a lower stop position, according to some embodiments.

FIG. 1 shows a cylinder-piston unit comprising a cylinder 1 which longitudinally displaceably accommodates a piston 5 therein. The cylinder 1 offers an upper stop for the piston 5 by way of a cylinder cover 2, and offers a lower stop (L) by way of a cylinder base 3. The swept volume extends therebetween and is sufficiently sized in such a way that an upright tube 15, which is connected to a piston rod 6 integral with the piston 5 and is part of a flush valve, can be lifted into an open position. For the purpose of fastening, the piston rod 6 comprises a head and a neck, wherein the neck has been threaded into a sliding bearing 16 of the upright tube. The lower stop position of the piston 5 is selected in such a way that the upright tube 15 is decoupled from the piston 5 in this position, and therefore the head does not about the sliding bearing, and so the flush valve is securely closed.

The cylinder 1 comprises, in the cylinder base 3 thereof, a sleeve-shaped passage 4, through which the piston rod protrudes into the cylinder 1. The piston rod 6 comprises multiple notches around the circumference thereof, in order to form a labyrinth seal in this region. A base of the sleeve-shaped passage 4 overhangs the cylinder base, and therefore a partial region of the cylinder is continually filled with water. Water rising thereabove can drain off through the labyrinth seal. In order to actuate the flush valve from this position and, therefore, to lift the upright tube 15, water under line pressure is allowed to flow under the piston 5 via a fluid inlet (not represented here), the water inflowing more rapidly than it can emerge from the cylinder 1 again via the labyrinth seal of the passage 4. An overpressure builds up under the piston 5 and pushes the piston 5 upward.

An annular seal 8 along the cylinder wall is provided on the edge of the piston 5 and expands, due to the inverted U-shaped cross-section thereof, as a result of the overpressure under the piston 5, thereby offering a good seal with respect to the cylinder wall. Air can escape from the space above the piston 5, however, and therefore no counteracting pressure is built up there.

Figure 2:
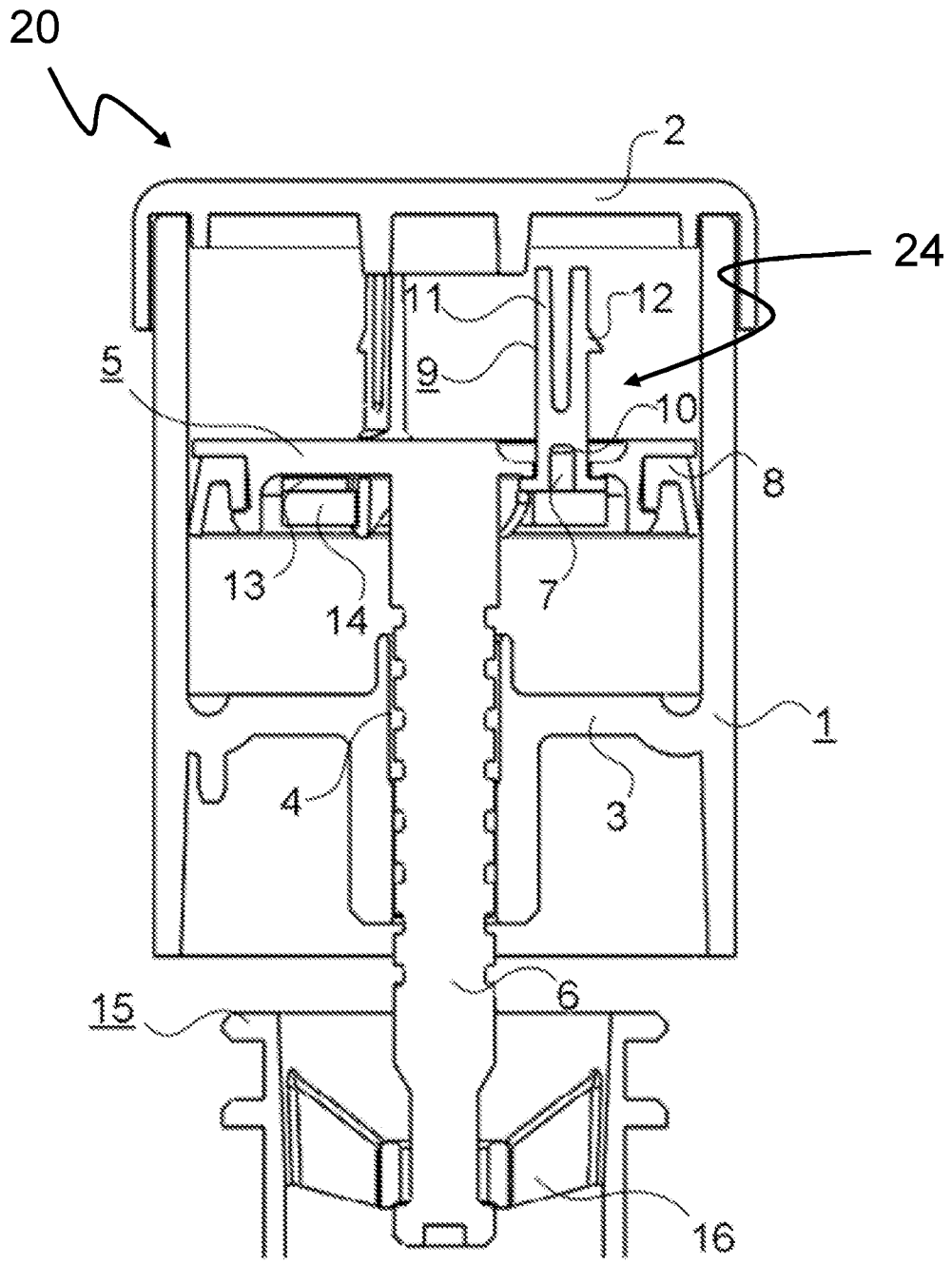
FIG. 2 shows a cross-sectional view from the side of the cylinder-piston unit according to FIG. 1 in a lifting position, according to some embodiments.

The piston 5 is pushed upward by way of the water pressure, as shown in FIG. 2. Although the piston 5 comprises passage openings 7, these passage openings are blocked in this position by the valve tappets 9 (valves 24). These valve tappets 9 comprise a closure section 10 sealing the passage openings 7, as well as a tapering 11 toward the top, which would hold a flow region open in the passage opening 7. In the position shown, the three passage openings 7 are blocked by the closure sections 10 of the valve tappets 9, and therefore the water pressure under the piston 5 can increase again. In this position, in addition, the upright tube 15 has already been drawn upward along with the piston rod 6 and begins to release the flush valve.

Figure 3:
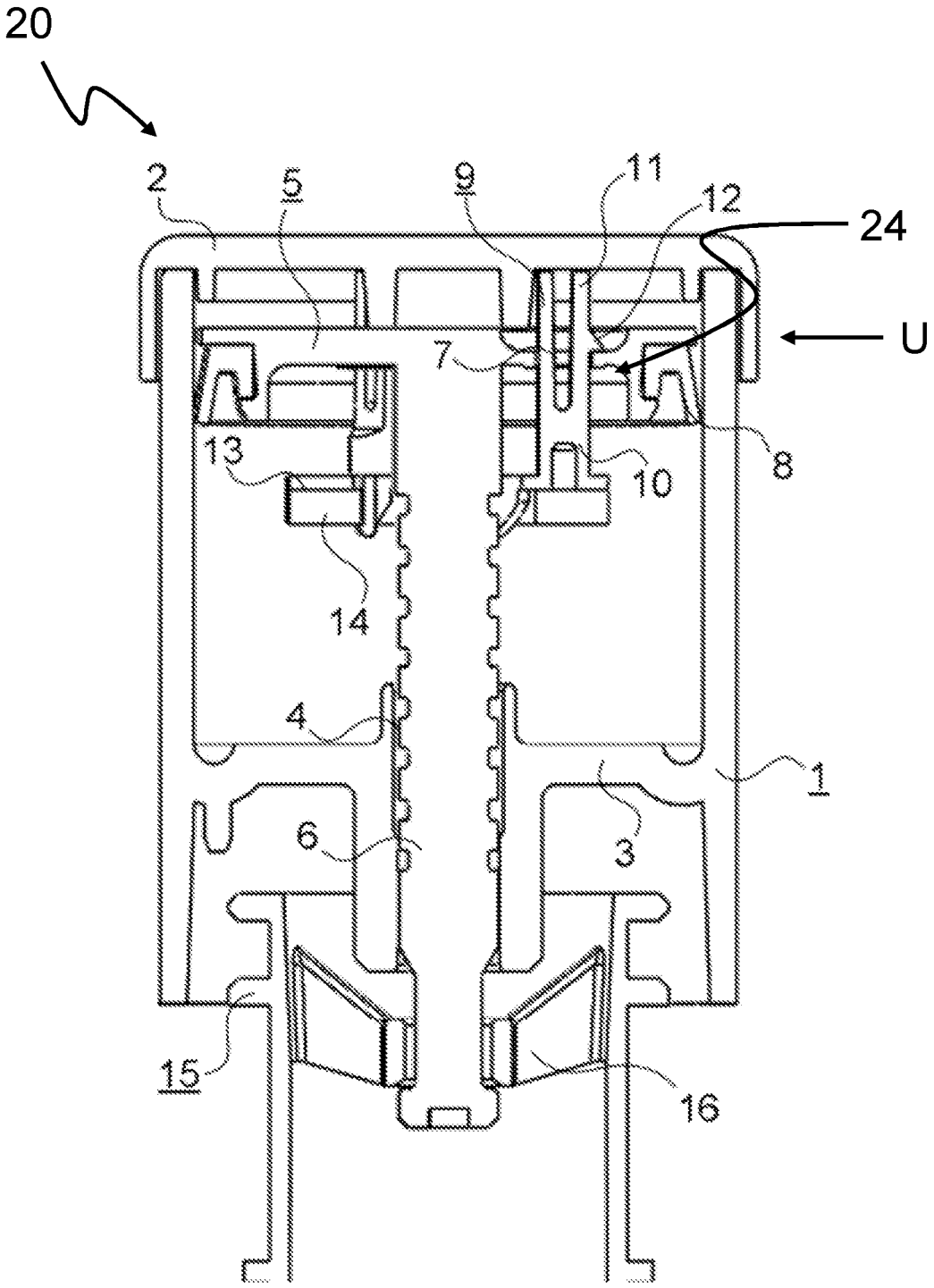
FIG. 3 shows a cross-sectional view from the side of the cylinder-piston unit according to FIG. 1 in an upper stop position, according to some embodiments.

As the water pressure continues to increase, the upper stop position (U) of the piston 5 shown in FIG. 3 is reached by the piston. Already shortly ahead of this position, the valve tappets 9 impact the cylinder cover 2 via the upper edge thereof, and therefore the piston 5 can continue to move upward, but the valve tappets 9 cannot. The valve tappets 9 therefore push through the passage opening 7 until they can be prevented from descending further by way of a stop 12 of the valve tappets 8. The valve tappets are connected to each other by way of a connecting ring 13, which prevents a non-uniform triggering and a tilting.

Figure 4:
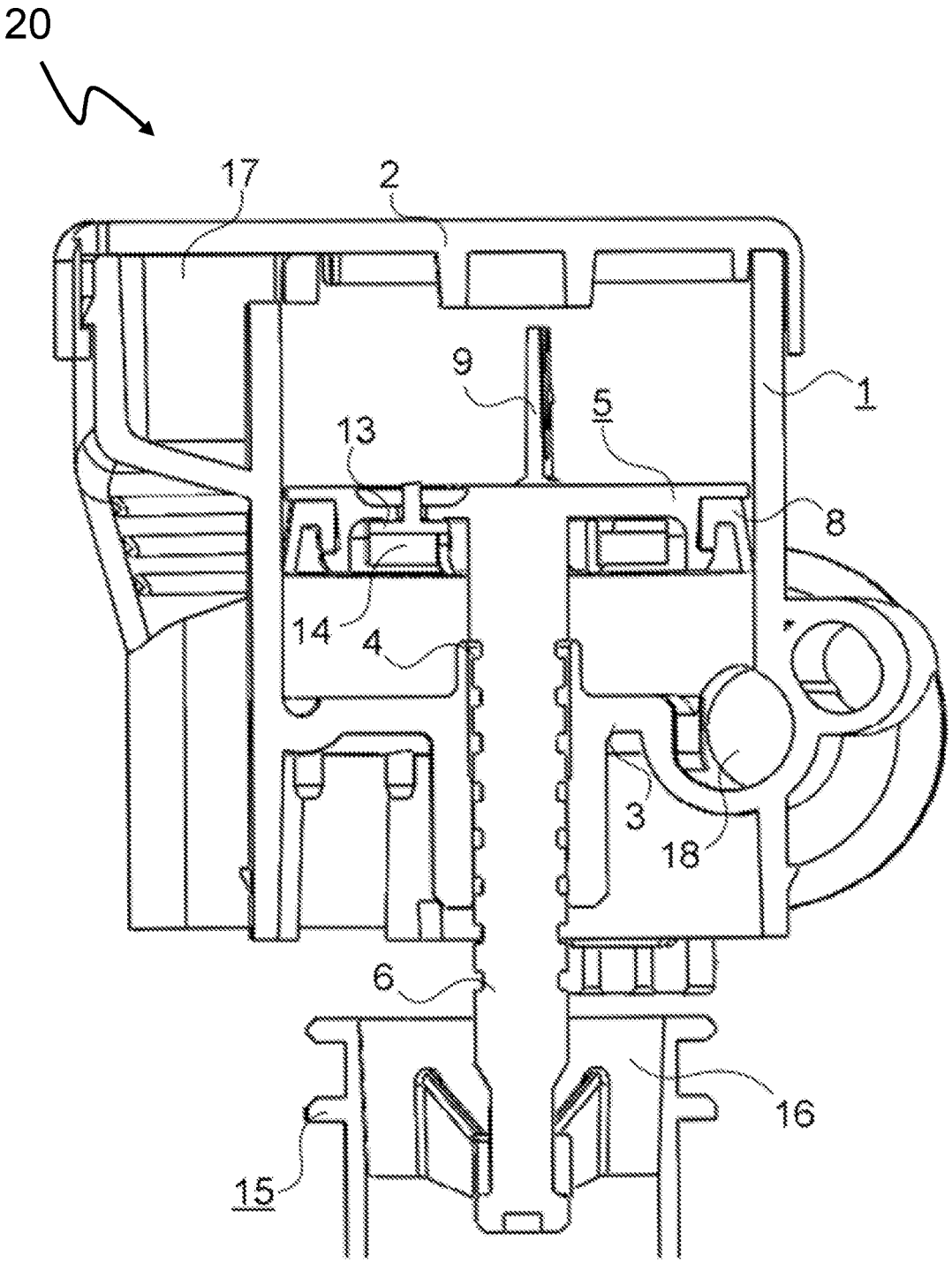
FIG. 4 shows a cross-sectional view of the cylinder-piston unit according to FIG. 2 in a lifting position from another side, according to some embodiments.
Figure 5:
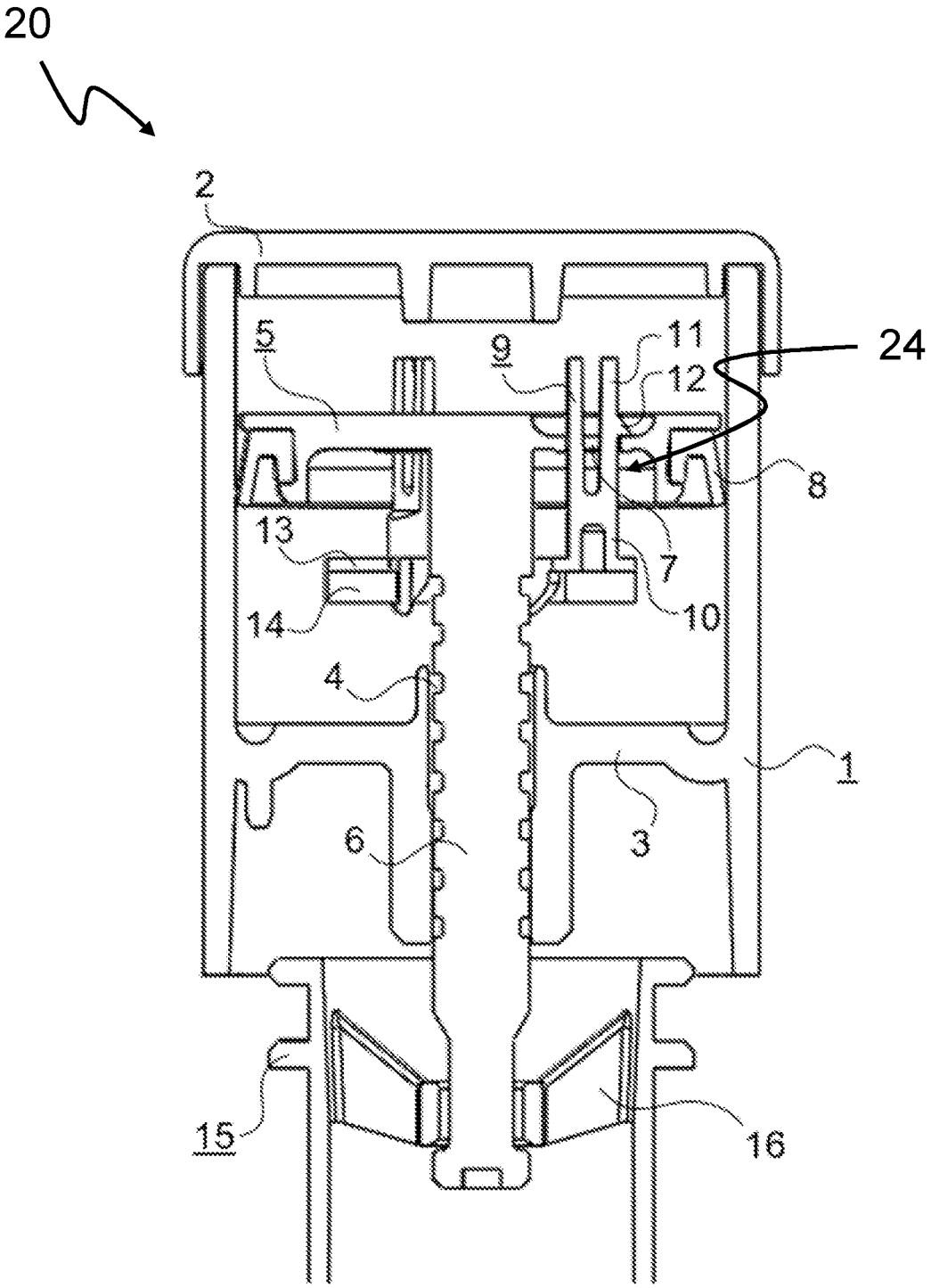
FIG. 5 shows a cross-sectional view from the side of the cylinder-piston unit according to FIG. 1 in an output position, according to some embodiments.

The valve tappets now block the passage openings 7 only by way of one central web which is a tapering 11. Water can reach the piston therethrough and can run out into the cistern via an overflow 17. This is shown in FIG. 4 which depicts a cross-section from another direction, in which both the inlet 18 as well as the overflow 17 are represented. The water initially continuing to flow in through the inlet 18 will push the piston 5 upward, but the pressure under the piston 5 will rapidly decrease. If the inflow through the inlet 18 finally ends by way of the flush valve being closed, the pressure under the piston 5 is reduced to such an extent that the piston can descend again. This final phase of the flushing process is shown in FIG. 5. Since the valve tappets 9 and the connecting ring 13 connecting them are made of a light-weight plastic, a circumferential lowering weight 14 is assigned to the connecting ring 13, which is intended to prevent the valve tappets 9 from being pushed back into the closed position thereof due to the remaining water pressure. While the remaining water escapes from the cylinder through the passage 4 and the upright tube 15, the piston 5 descends back into the position shown in FIG. 1, wherein the valve tappets 9 block the passage openings 7 again due to the lower stop. In this position, the upright tube 15 is then decoupled from the piston rod 6 again, in order to be able to descend all the way back into the lower final position, and the flush valve is completely closed, and therefore the cistern can be filled again.

Figure 6:
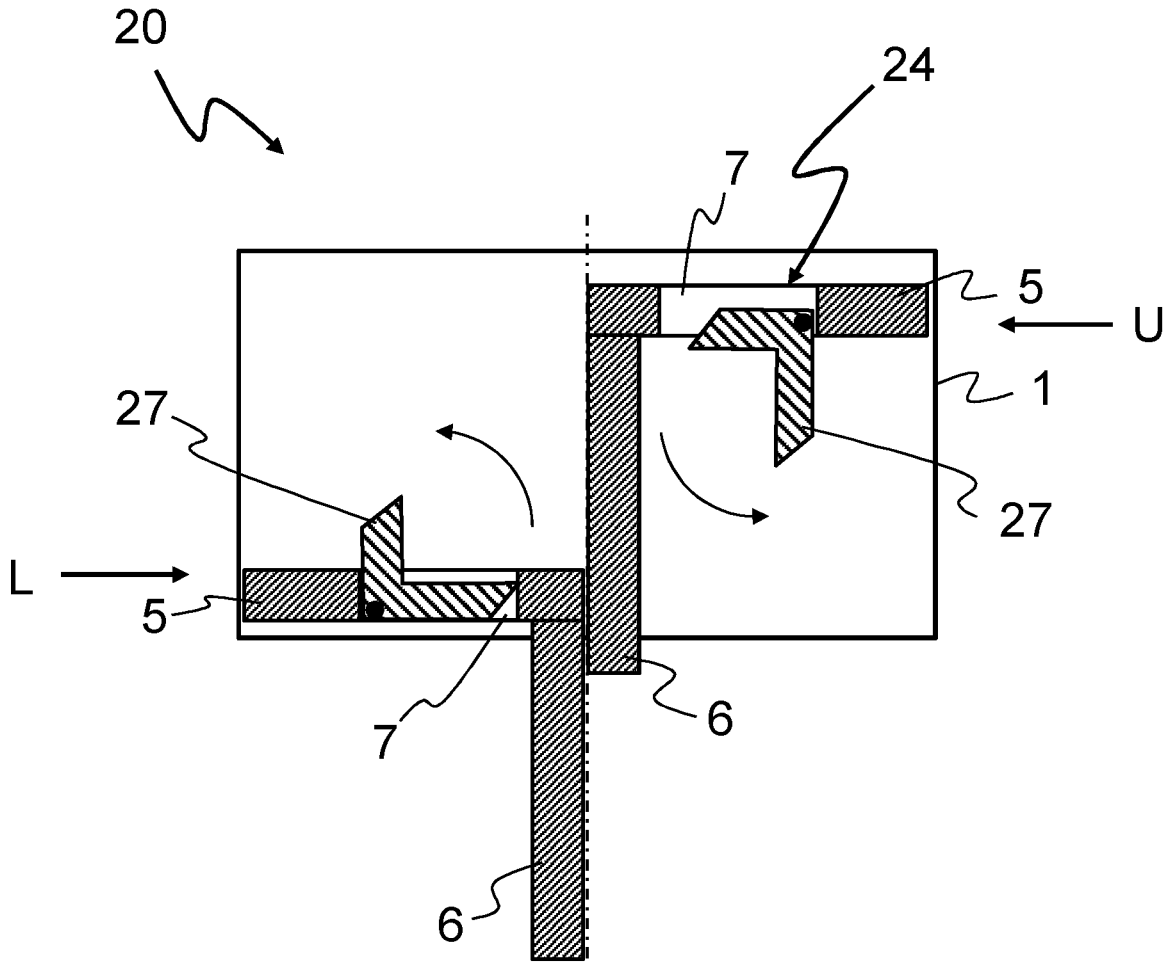
FIG. 6 shows a cross-sectional view from the side of a cylinder-piston unit comprising multiple snap-fit closures, according to some embodiments.

FIG. 6 shows a cylinder-piston unit according to the second embodiment. Assigned to the at least one passage opening 7 of the piston 5 is an exemplary snap-fit closure 27 which, upon reaching the upper stop position (U, see right side of FIG. 6), snaps into an open position and, upon reaching the lower stop position (L, see left side of FIG. 6), snaps back into a closed position.

Figure 7:
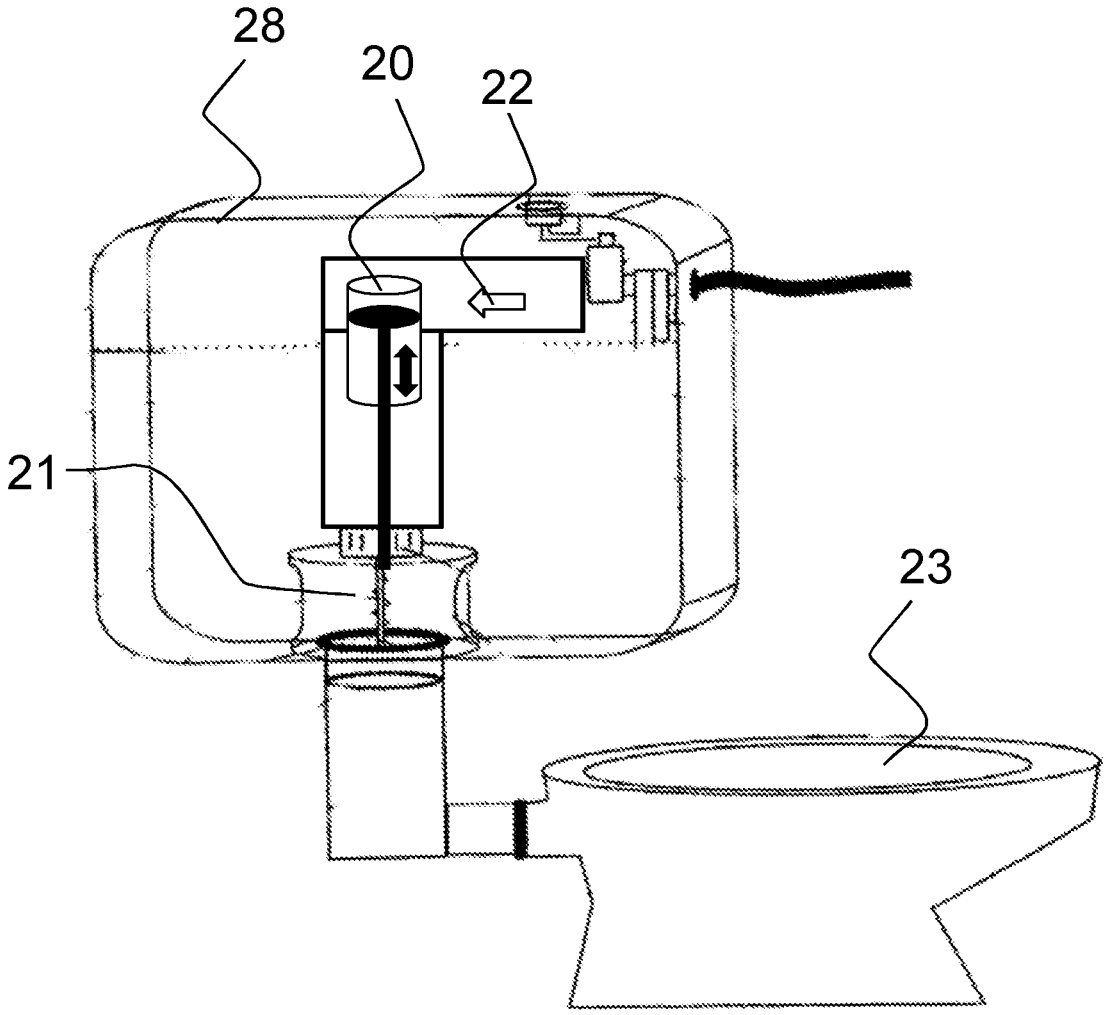
FIG. 7 shows a toilet with cistern and a flush valve according to some embodiments.

FIG. 7 shows a flush valve 21, in which a triggering of the flushing process in a cistern 28 is to take place by means of the inflow (fluid inlet 22) of tap water. In this case, the tap water is introduced into the cylinder-piston unit 20. Since the piston rod is connected to the flush valve, the flush valve is lifted off of the valve seat along with the lifting of the piston in the cylinder-piston unit 20, and the flushing process can take place e.g. water is released via the fluid outlet 23 into the toilet 23.

A cylinder-piston unit is therefore described above, which provides a piston comprising a valve which is opened and closed in a displacement-controlled manner and, therefore, can bring about a reliable triggering of a flushing process and the termination thereof, independently of the prevailing water pressure.

Numerous flush valves are known from the prior art, which utilize the line pressure in order to trigger the actual flushing process. This makes it possible to largely dispense with actuators which, in the field of sanitation, can result in a conflict between the use of electricity and water. In this case, in the prior art, the pistons are pushed against the force of a compression spring, and therefore the compression spring can return the piston to the starting position as the pressure decreases. This means, however, that the compression spring must, in some embodiments, be adapted to the water pressure prevailing in a region, and therefore a suitable compression spring must, in some embodiments, be initially found, during installation, in order to ensure optimal function. This problem is solved by the disclosure, in that the disclosure adds a valve to the piston, which is opened and closed in a displacement-controlled manner and, therefore, can bring about a reliable triggering of a flushing process and the termination thereof, independently of the prevailing water pressure.

The invention claimed is:

1. A cylinder-piston unit for actuating a flush valve, comprising:

a cylinder;

a piston which is displaceably mounted in the cylinder;

a piston rod which is operatively connected to the flush valve, and at least one fluid inlet, which opens into the cylinder at or below a lower stop position of the piston; and at least one fluid outlet, wherein the piston comprises at least one valve which seals the piston in a lower stop position and opens at least one passage opening in an upper stop position.

2. The cylinder-piston unit of claim 1, wherein the piston comprises multiple valves, each of which seals the piston in the lower stop position and opens at least one passage opening in the upper stop position, the valves being situated on the piston so as to be distributed uniformly and with circular symmetry.

3. The cylinder-piston unit of claim 1, wherein a valve tappet, which engages through at least one passage opening of the piston, is longitudinally displaceably, and captively accommodated in the cylinder-piston unit.

4. The cylinder-piston unit of claim 3, wherein the valve tappet completely seals the passage opening via a lower closure section and tapers in the upward direction.

5. The cylinder-piston unit of claim 3, wherein the piston has multiple passage openings assigned to the piston, and wherein the multiple passage openings are situated on the piston so as to be distributed uniformly and with circular symmetry.

6. The cylinder-piston unit of claim 5, wherein the valve tappet has a plurality of valve tappets and the valve tappets are connected to each other in a lower stop region of a connecting ring.

7. The cylinder-piston unit of claim 3, wherein the valve tappet has a stop in the form of a bulge preventing the valve tappet from descending further through the passage opening.

8. The cylinder-piston unit of claim 1, wherein a snap-fit closure is assigned to the at least one passage opening of the piston, the snap-fit closure, upon reaching the upper stop position, snaps into an open position and, upon reaching the lower stop position, snaps back into a closed position.

9. The cylinder-piston unit of claim 1, wherein the cylinder comprises, as a fluid outlet, a labyrinth seal surrounding the piston rod of the piston to allow fluid introduced into cylinder to seep out.

10. The cylinder-piston unit of claim 1, wherein the piston is surrounded, against the cylinder wall, by a sealing ring which has an at least approximately U-shaped cross-section, wherein the opening of the U-shape faces downward.

11. The cylinder-piston unit of claim 10, wherein the lower stop position of the piston is selected in such a way that, in this lower stop position, the piston rod is decoupled from the flush valve.

12. The cylinder-piston unit of claim 1, further comprising an overflow on an upper side.

13. A method for actuating a flush valve with a cylinder-piston unit, the cylinder-piston unit comprising a piston which is displaceably mounted in a cylinder and a piston rod which is operatively connected to the flush valve, and comprising at least one fluid inlet, which opens into the cylinder at or below a lower stop position of the piston, and comprising at least one fluid outlet, the method comprising:

a) lifting the piston from its lower stop position by introducing fluid through the at least one fluid inlet into the cylinder, wherein the piston comprises at least one valve which seals the piston in its lower stop position, b) triggering the at least one valve to open at least one passage opening in the piston when or before the piston reaches its upper stop position, so that the fluid, which has been located beneath the piston so far, can now also pass through the piston into the region above the piston, where the fluid passing through the piston can leave the cylinder via the at least one fluid outlet, and c) triggering the at least one valve to close the at least one passage opening in the piston when the piston engages into its lower stop position.

14. The method of claim 12, wherein the triggering of the at least one valve occurs displacement-controlled.

* * * * *